United States Patent [19]

Vorbach et al.

[11] Patent Number: 4,771,624

[45] Date of Patent: Sep. 20, 1988

[54] THRUST MOUNT FOR TUBE ROLLING MILLS

[75] Inventors: E. Vorbach, Monchen-Gladbach; M. Schoenen, Mettmann, both of Fed. Rep. of Germany

[73] Assignee: Mannesmann AG, Duesseldorf, Fed. Rep. of Germany

[21] Appl. No.: 3,807

[22] Filed: Jan. 16, 1987

[30] Foreign Application Priority Data

Jan. 24, 1986 [DE] Fed. Rep. of Germany ..... 3602523

[51] Int. Cl.[4] ..... B21B 19/06

[52] U.S. Cl. ..... 72/96; 72/430

[58] Field of Search ..... 72/95, 96, 97, 430; 310/66, 68

[56] References Cited

U.S. PATENT DOCUMENTS 2,039,146 4/1936 Burrell ..... 310/66

3,566,653 3/1971 Unrath ..... 72/96

*Primary Examiner*—Lowell A. Larson

*Attorney, Agent, or Firm*—Ralf H. Siegemund

[57] ABSTRACT

A mandrel rod is rotatably held against axial displacement and serves as rotor for an asynchronous motor causing the mandrel to rotate so that little, if any, wear occurs on the mandrel as engaging the rolled hollow.

1 Claim, 1 Drawing Sheet

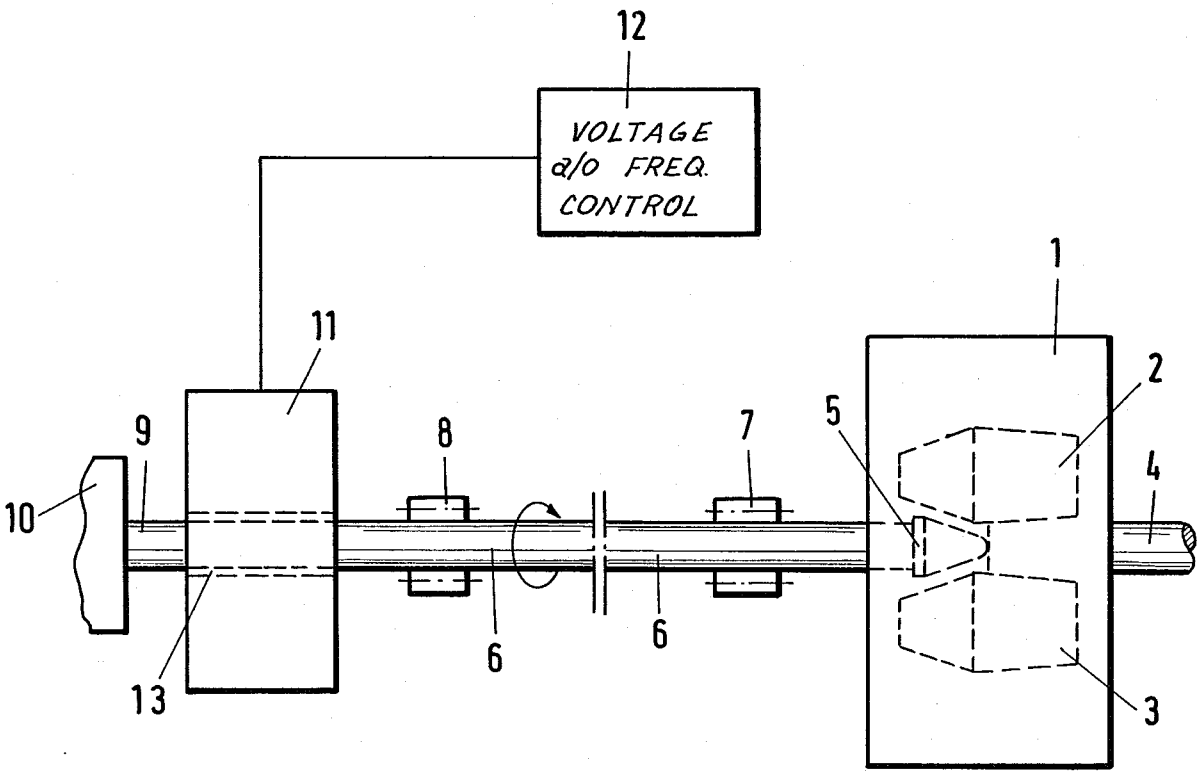
1
2
3
4
5
6
6
7
8
9
10
11
12
13
VOLTAGE
a/o FREQ.
CONTROL

THRUST MOUNT FOR TUBE ROLLING MILLS

BACKGROUND OF THE INVENTION

The present invention relates to a mount and support to be used in and being a part of a rolling mill for rolling hollows including a rotating internal tool; further having a tool rod which bears against the mount to take up the reaction force of rolling operating in axial fashion. The support and mount being a thrust mount is of carriage-like construction to be movable for purposes of tool and rod change; furthermore, the tool rod is (a) supported transversely to the axis of rolling and (b) caused to rotate about its longitudinal axis.

Rolling mills of the type to which the invention pertains are in the foregoing broadly characterized. This is realized, for example, in rolling mills with oblique and inclined roll axes being provided for piercing billets or for stretching or widening existing hollows. The internal tool referred to above is in these cases a mandrel which is held on a rod between the rolls. Even if the mandrel is rotatably mounted on the mandrel rod there is a significant wear whenever the mandrel it has to be set into rotation inside the rolled stock.

European Pat. No. 41 464 suggests to couple the mandrel rod at its rear, free end mechanically with a rotational drive so that during rolling a synchronization obtains as between the rotation of the rolled stock and of the mandrel. However, this arrangement is disadvantaged by the fact that the mechanical wear of the mandrel is now in effect shifted over to a stop and to the end of the tool holder i.e. the mandrel. This in turn interferes with the exactitude that is necessary for maintaining the axial position relative to the rolls as this position has to be maintained for adequacy of the rolling process. Also, this known approach is disadvantaged in that the mandrel position depends now exclusively on the cooperation of planar support surfaces of the stop with the reaction of the rolls themselves. Axially retracting the mandrel from the stand is possible only if one has, in fact, sufficiently high reaction forces of rolling.

DESCRIPTION OF THE INVENTION

It is an object of the present invention to improve the conditions of wear of the mandrel (tool) as well as of the mandrel rod (tool holder) in mills of the type referred to above, while maintaining the principle of positive axial retention, on one hand, and adjustability of the mandrel, on the other hand.

In accordance with the preferred embodiment of the present invention, it is suggested to tie the tool rod, e.g. a mandrel, in the thrust mount in the axial direction of rolling and of the reaction forces; the end of the rod is constructed without steps as a rotor in an asynchronous poly-phase motor, for rotating the mandrel rod about its longitudinal axis. The stator of that motor is either mounted stationarily or on the carriage of the thrust mount, and the poly-phase current supply is controlled as to voltage and/or frequency for controlling the forces acting on that rotor end of the mandrel rod.

The first mentioned characterizing feature reliably holds the mandrel between the rolls in the particular cross-section and with reference to the plane that runs through the closest distance between the rolls. Holding the mandrel in this fashion is independent from the reaction of rolling. Therefore, this holder can be made with little wear in mind, as an axial carrying mount. This way, it is made possible to retract the mandrel or tool holder from the stand and to change rods with each hollow. Stripping the hollow from the rod or shifting a hollow to be stretched upon the rod can be carried out outside of the line of rolling. This feature improves significantly holding and adjusting of the mandrel which is of high advantage under consideration of the cyclic sequence of a rolling process. It is, in fact, a significant improvement over the prior art.

Constructing and operating the mandrel rod end as a rotor and related features are all designed toward reducing wear generally by means of causing the mandrel, i.e. the internal tool to rotate in a readily yielding fashion. The tool rod is set into rotary motion after placement, and after the mandrel is shifted in-between the rolls but preferably prior to the beginning of rolling. This then establishes a significant difference over prior art practice, where the rotation is carried out exclusively under utilization of reaction of the rolling process itself and in accordance to which the mandrel rod is driven from the rolls via the rolled stock and the mandrel. Before synchronization is obtained, the engaging surfaces of the stop and the rear end of the rod wear heavily.

These disadvantages are avoided which weighs heavily, particular in those instances in which the mill produces tubes of medium size diameter. In this case, for example, the mandrel diameter is between 150 and 350 mm but may, in cases, even be as large as 600 mm. In all these cases, the mandrel rods each weigh more than a metric ton, even several metric tons. But in spite of these large masses, tests yielded the result that a rotation for the rods of about 500 rpm occurs with an air gap between stator and tool rod of several millimeters; that rotational speed can, in fact, be obtained in less than a second. This then demonstrates the practicability of the invention.

DESCRIPTION OF THE DRAWINGS

While the specification concludes with claims particularly pointing out and distinctly claiming the subject matter which is regarded as the invention, it is believed that the invention, the objects, and features of the invention and further objects, features and advantages thereof will be better understood from the following description taken in connection with the accompanying drawings in which:

The FIGURE shows somewhat schematically a top elevation of a piercing mill, using rolls with oblique axes.

The FIGURE shows a rolling stand and frame 1 with rolls 2 and 3 of generally barrel-shaped configuration. The oblique position of the rolls is not visible but is established as follows. The roll 2 is, so to speak, tilted up on the feed side, which is the right-hand side of the FIGURE, while roll 3 is tilted up on the exit side. Reference numeral 4 refers to a solid billet of round, cylindrical configuration from which a hollow is to be made through piercing. A mandrel drive is disposed between the rolls 2 and 3. During rolling, by operation of the rolls 2 and 3 the solid billet 4, is so to speak, shifted over the mandrel to obtain the piercing action, whereby, in addition, longitudinal stretching obtains. The mandrel 5 is arranged on a mandrel rod 6; the mandrel 5 is either rotatable relative to the rod 6, or prevented from rotation. Moreover, the mandrel 5 may be axially displaceable on the rod or be held against axial displacement. This depends on different conditions of rolling. The invention is practiced independent from this relation between the mandrel and the mandrel rod.

The rod 6, moreover, is held and supported or guided in mounts and support 7 and 8, to hold the rod against lateral displacement. However, tight mounting is not required. The other end of the rod 6, not carrying the mandrel, is denoted with reference numeral 9, and here, the rod 6 is rotatably mounted in a thrust mount 10. The mount 10 provides for axial support of the mandrel rod as against axial displacement. During rolling, mount 10 is held in a stationary position. The mount 10 is, however, situated on a carriage to permit withdrawal of the mandrel from the stand. The thrust mount 10 is thus displaceable in the direction of rolling which is, for example, to the left in the FIGURE. The displacement is to be sufficient so that the rod 6 as well as the mandrel 5 will emerge from the frame 1. Upon sliding thrust mount 10 in the direction of rolling, the support 7 and 8 as well as the frame 11 may actually be permitted to follow, i.e. these supports may be on or connected to the thrust mount carriage.

Reference numeral 11 refers to the stator of a motor and is assembled of laminar sheets of the type used, for example, for electrical transformers and carries the coils of an asynchronously poly-phase motor. The stator circumscribes the smooth cylindrical rod 6, there being an air gap 13 in-between, which is, for example, 5 mm. The gap is sufficiently large so that, in fact, the support in mounts 7 and 8 will avoid engagement between stator 11 and rod 6. Hence, that end portion of the mandrel rod 6 serves as rotor of the motor.

Reference numeral 12 refers to a poly-phase, e.g. three power supply to which the coil or coils of the stator 11 are connected. The power supply 12 may provide voltage or frequency control for the electrical rotating filed that is set up by the stator coil. The electrical field uses the rod 6 as rotor and causes that rotor to rotate, already before the billet 4 is pushed into the stand from the outside, and by means of a suitable pusher, in-between the rolls 2 and 3. Accordingly, the mandrel yieldingly couples to the billet as soon as rolling begins.

The invention is not limited to the embodiments described above, but all changes and modifications thereof, not constituting departures from the spirit and scope of the invention, are intended to be included.

We claim:

1. In a tube rolling mill, having rolls cooperating with an internal tool on a tool holding rod, the improvement comprising:

an axially displaceable thrust mount for holding a rear end of the rod and opposite its tool holding end, the rear end of the rod being mounted for rotation in the thrust mount;

means for mounting and holding the rod separately from the thrust mount and preventing lateral displacement of the rod;

means defining a stator of an asynchronous motor, circumscribing a portion of the tool rod, that portion constituting a rotor for the motor, that portion having the same diameter as the diameter of the rod outside of the stator; and means connected for controlling voltage and/or frequency of electric power supplied to said stator.

* * * * *